US005588270A

United States Patent [19]

Keating

[11] Patent Number: 5,588,270

[45] Date of Patent: Dec. 31, 1996

[54] GARAGE DOOR BRACE

[76] Inventor: Carey E. Keating, 2106, 13531 Deer Run Boulevard SE., Calgary, Alberta, Canada, T2P 6P9

[21] Appl. No.: 494,947

[22] Filed: Jun. 26, 1995

[51] Int. Cl.[6] ..... E04G 23/00

[52] U.S. Cl. ..... 52/291; 52/223.1; 52/223.6; 52/573.1; 52/801.12; 160/201

[58] Field of Search ..... 52/223.1, 223.6, 52/223.7, 291, 573.1, 656.2, 656.4, 656.7, 693, 800.1, 801.1, 801.11, 801.12; 160/201, 229.1, 236

[56] References Cited

U.S. PATENT DOCUMENTS

| | | | |
|---|---|---|---|
| 2,804,953 | 9/1957 | Buehler | 52/291 X |
| 3,176,757 | 4/1965 | Lomaz | 160/201 X |
| 3,424,223 | 1/1969 | Rosenblatt | 160/201 X |
| 4,704,830 | 11/1987 | Magadini | 52/729.1 X |
| 4,918,890 | 4/1990 | Stafford | 52/291 |
| 4,987,941 | 1/1991 | Wold | 160/201 X |
| 5,205,096 | 4/1993 | Pace | 52/291 X |

*Primary Examiner*—Wynn E. Wood
*Assistant Examiner*—Kevin D. Wilkens
*Attorney, Agent, or Firm*—George Dunsmuir

[57] ABSTRACT

A reinforcing arrangement or device which substantially prevents sagging of the lower section of a multi-sectional Up and over type door. The natural load on the lower center of the bottom panel of the door being upwardly and vertically controlled and translated laterally and downwardly to the bottom corners the door by the device, to maintain overall conformity.

4 Claims, 4 Drawing Sheets

GARAGE DOOR BRACE

BACKGROUND OF THE INVENTION

The invention relates to an arrangement for reinforcing a door, particularly a multi-sectional garage door of the sliding, or up and over type.

Conventional doors of this type, particularly as used in double car garages are generally constructed of horizontal, elongated sections, hingedly attached one to the other. Rollers positioned on each side of each section cooperate with tracks in a conventional garage door frame such that the door can be moved between an open or closed position. To assist the user in raising and lowering the door, springs and cables are utilized to balance the weight of the door and reduce the load.

Such double-width doors tend to sag as time progresses, this problem is due mainly to the combination of the upward spring tension on the sides of the door, or the manner in which the cable assembly is attached to the lower side corners of the door, where the entire weight of the door is carried.

To provide reinforcement for doors is not new, as can be seen from Canadian Patents Nos. 186374 issued to J. Little in Sep. 1918; 517184 issued to J. F. McKee in Oct. of 1955; and U.S. Pat. No. 2804953 issued to A. M. Buehler in Dec. 1955. However, none of these prior art structures can be utilized in connection with folding, multi-sectional doors.

An attempt was made to solve this problem by Robert Wold who obtained Canadian Patent No. 1299493 on the 28th of Apr. 1992. This arrangement in structural terms is reverse to that of the subject application and substantially more complicated.

The object of the present invention is therefore to provide a simple and effective device for use in the reinforcement of multi-sectional doors.

SUMMARY OF THE INVENTION

Accordingly, the present invention provides a system for reinforcing multi-sectional doors of the type including multiple horizontal panels interconnected at each longitudinal side to adjacent panels, the system includes corner reinforcing plates adapted to be attached to opposite lower corners of a bottom panel structure of a door. The longitudinal struts are attached to each of the corner plates and extend upwardly and inwardly of the panel structure. The upper end of each strut being attached to an upper connector such that a combination of the corner plates, struts, and connector define a substantially rigid triangular frame within the confines of the lower panel section of the door structure. A load pin extends downwardly from the upper connector to a lower bracket, the latter being attached to the bottom of the door. An intermediate bracket located vertically above the lower bracket and also attached to the door is positioned to support and locate the pin which is positioned through apertures in both the lower bracket, intermediate bracket and upper connector. A locking nut arrangement maintains the pin in position on the lower bracket and provides means for adjusting the height of the pin. A nut is provided at the upper threaded end of the pin which when tightened, exerts an upward pull on the bottom of the door, while exerting a compressive force via the struts to the corner plates, hence substantially eliminating sagging.

BRIEF DESCRIPTION OF THE DRAWINGS

The invention will now be described by way of example only, reference being had to the accompanying drawings in which.

DESCRIPTION OF THE PREFERRED EMBODIMENTS

Figure 1:
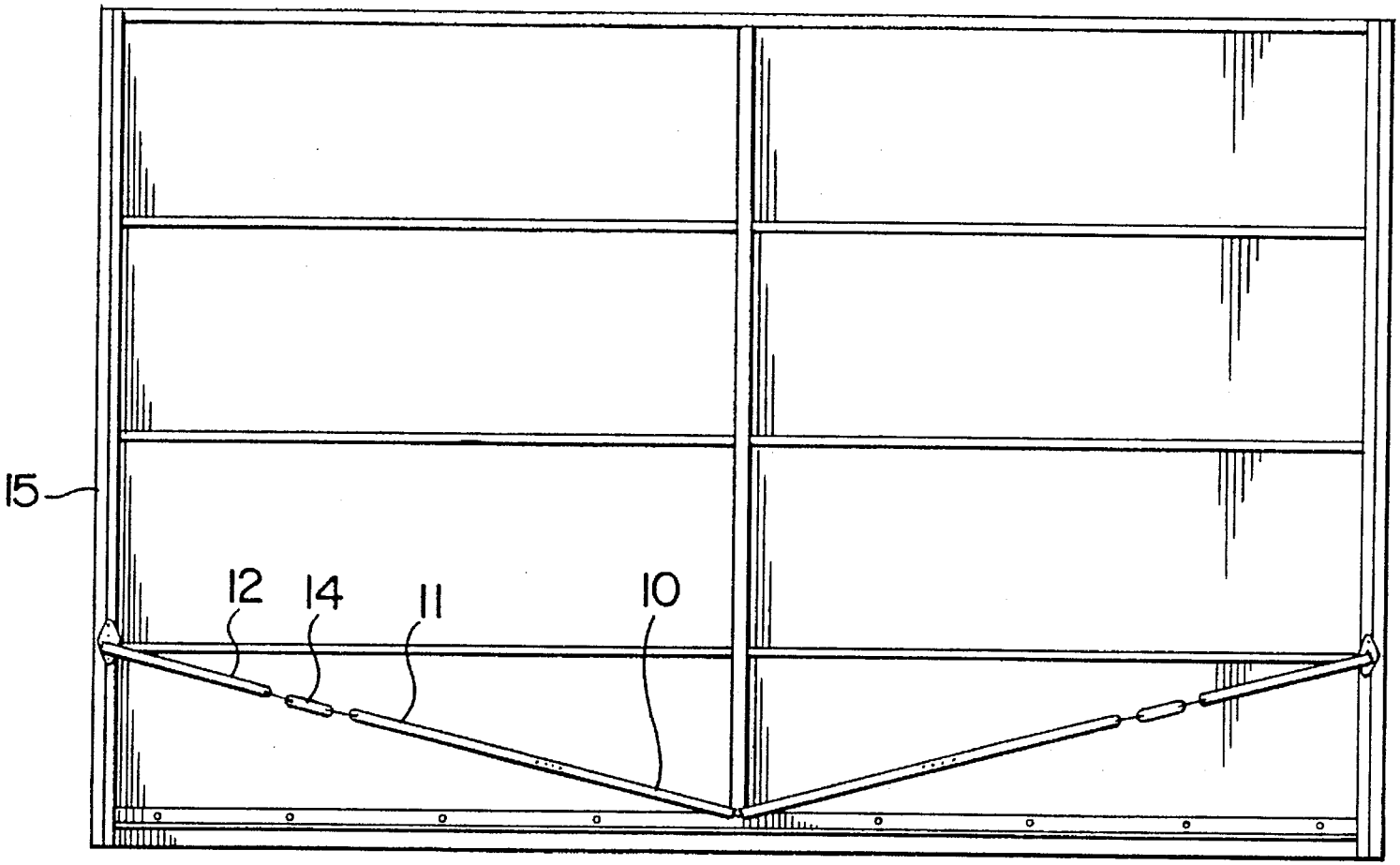
FIG. 1 (PRIOR ART)
FIG. 1 is an elevational view of the inside of a multi-sectional door with a reinforcing device in accordance with prior art.

Referring to the drawings, the prior art structure shown in FIG. 1 is that disclosed in previously referenced Canadian Patent No. 1299493. The device shown comprises two composite struts each including three flat metal strips 10, 11 and 12, and an associated intermediate turnbuckle 14. The lower ends of strips 10 are connected pivotally to the bottom centre of the frame of a panel 2 of the door, and the upper ends of strip 12 ace connected to the side edge on the lower edge of the frame of the door frame 15.

Turnbuckle 14 is connected between strips 11 and 12. The principle behind this prior art structure is that by adjusting each turnbuckle separately, one can exert an upward and angularly outwardly outer force on the bottom of the door, ostensibly to offset sagging.

Since the two composite struts of the prior art are fixedly attached to the bottom centre of the door and to the edge of door frame 15, it is necessary to provide for adjustment in length of each strut to compensate for dimensional changes hence the requirement for two inter-connected members 11 and 12, with associated connectors. One major problem witch the prior art arrangement panel is that the door panel is caused to bow outwardly or inwardly upon turnbuckle adjustment.

Figure 2:
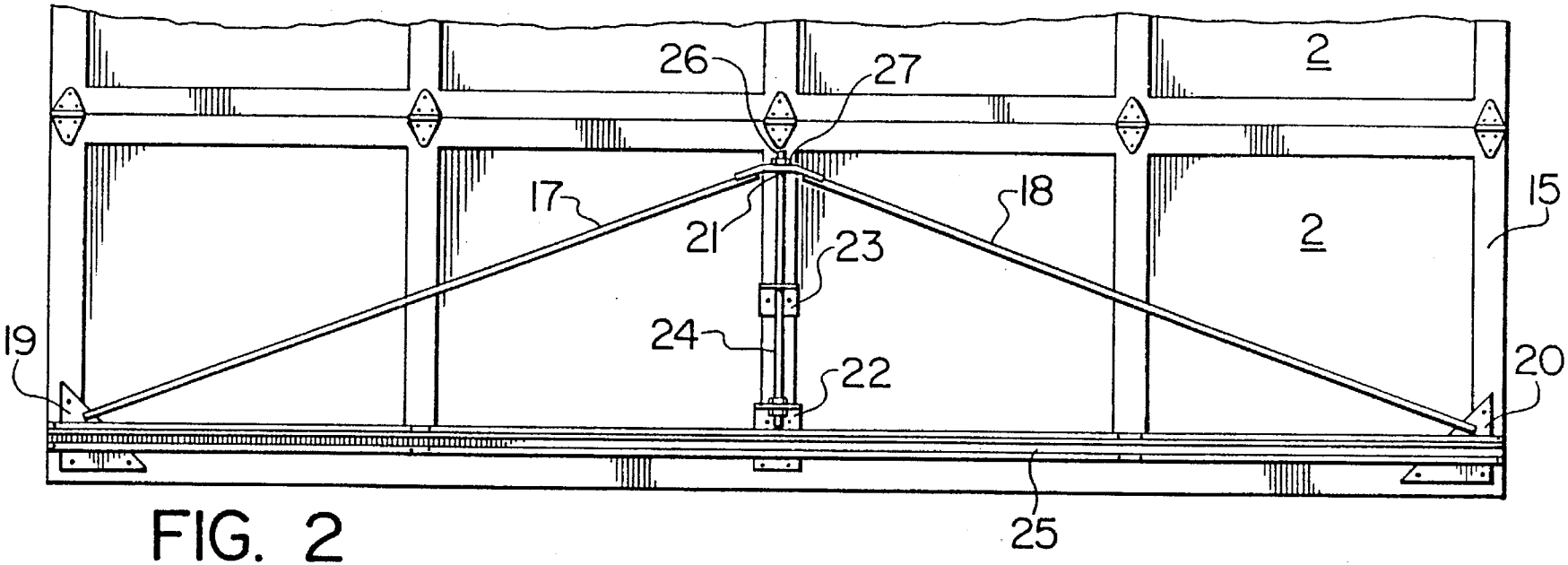
FIG. 2 is an elevational view of the inside of a multi-sectional door with a reinforcing device in accordance with the present invention.

The present invention, as can be seen from FIG. 2, comprises the following components: Two flat metal strips 17 and 18; bottom corner door plates 19 and 20; upper bracket 21; lower bracket 22; intermediate bracket 23; and load pin 24. The two struts or strips 17 and 18 are rigidly attached, for example, as by welding, at upper and lower ends to the upper bracket 21, and bottom corner plates 19 and 20, respectively, to provide for a rigid, substantially triangular framework.

Bottom corner plates 19 and 20 are attached by suitable means to the lower corners of the door and to a conventional spreader plate or bar 25, the latter being generally included as part of the door structure on installation. Bar 25 serves to maintain the constant width of the door, hold the bottom of the door rigid, and to prevent downward sag when the door is in the raised position.

Load in or shaft 24 (FIG. 4) is a rod of circular cross-section, the upper and lower ends 26 and 26A being threaded.

Figure 4:
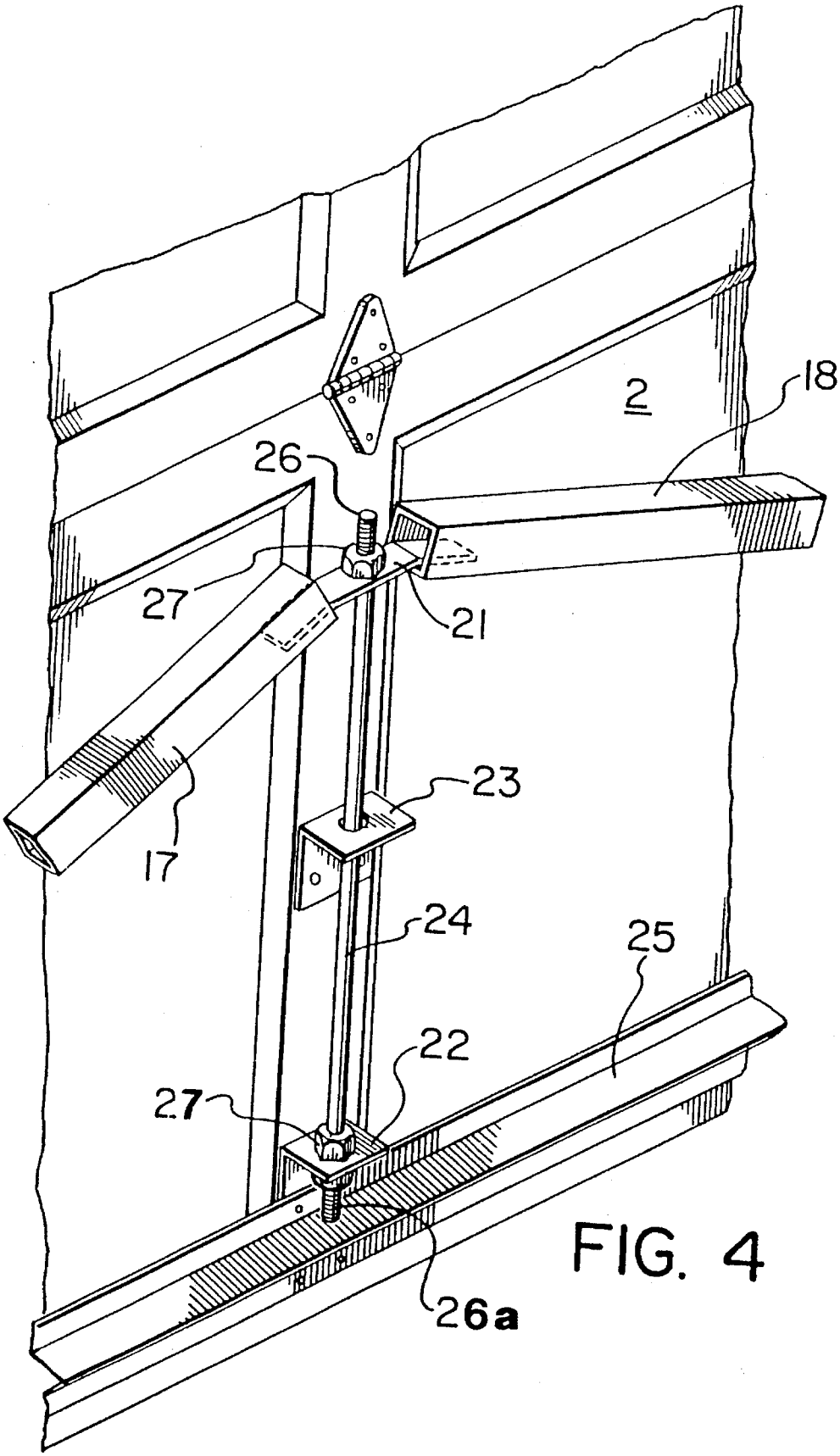
FIG. 4 is a perspective view of the load pin assembly of the device according to FIG. 2 showing a structural variation.

Load pin 24 is centrally and vertically located on a framing member of lower panel 2 of the door and is held vertically in respect of the inside of the door by brackets 22 and 23, both of which brackets are attached, by either bolts or rivets, as can be seen from FIG. 2 and 4, to the lower section or panel 2 of the door.

Intermediate bracket 23 has a centrally aligned hole through which shaft or pin 24 freely passes, this bracket simply acts as a stabilizer or guide for pin 24, and in effect supports the reinforcing device from movement when the garage doors are in the raised or upper overhead position.

Lower bracket 22 also has a central hole through which pin 24 passes, which serves to anchor the pin 24 but, by means of a lock nut system 27, permits vertical adjustment of the pin 24 to facilitate accurate component assembly.

Figure 3:
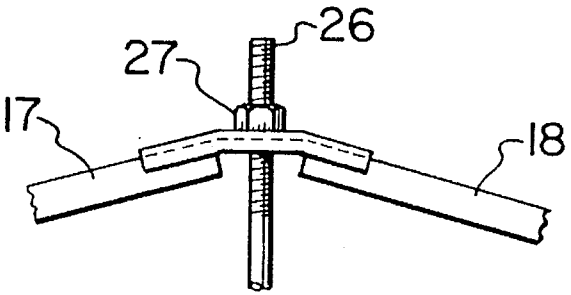
FIG. 3 is a detailed elevational view of the upper portion of the device according to FIG. 2.

Finally, as can be seen from FIGS. 2, 3 and 4, upper bracket 21 also has a hole to permit the upper end of the shaft to freely pass through, and a nut 27 is included to threadably engage with the upper end 26 of pin 24 to bear against the upper surface of bracket 21.

As will be appreciated, following component assembly, by tightening nut 27, an upward force is applied via the load pin or shaft 24 to the bottom center of the door. At the same time, a compression force is translated through struts 17 and 18 to respective bottom plates 19 and 20 and hence by their attachment, to the lower corners of the door.

Therefore, by installing a device of the present invention to either a new door, where all components will be welded rigidly one to the other as required, or to an existing door, in a retrofit, in kit form, where all components are individually attached such that a central system is provided whereby sagging is substantially controlled or eliminated.

Figure 5:
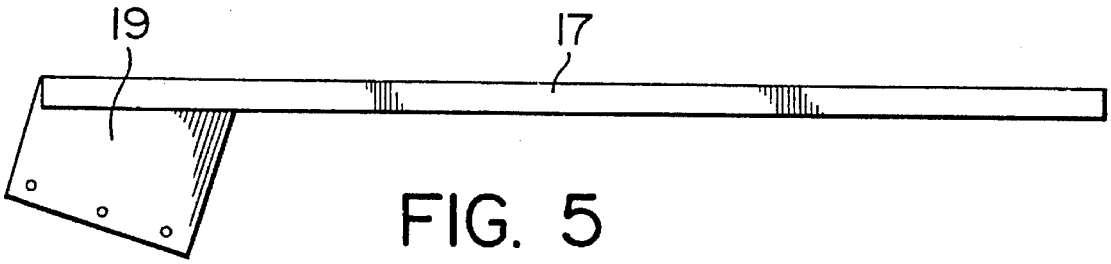
FIG. 5 is an elevational view of one strut of the reinforcing device according to FIG. 4.
Figure 6:
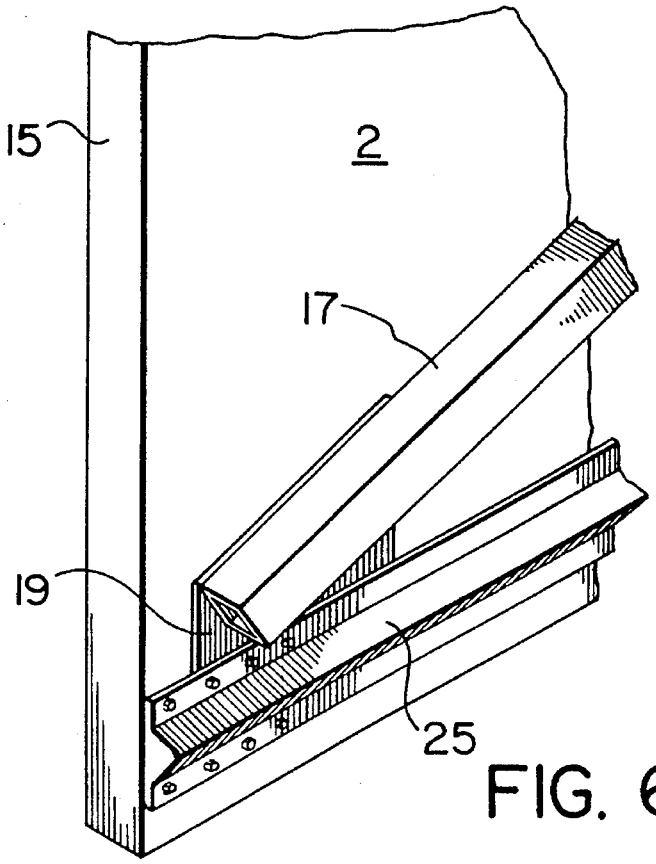
FIG. 6 is a perspective detailed view of a corner structure according to FIG. 4.

As can be seen from the drawings provided herein, there are certain structural differences as between FIG. 2 and FIG. 4. Whereas in its simplest form, (FIG. 2), the struts 17 and 18 can be flat, metal strips or bars, in FIG. 4, 5 and 6 the arrangement utilizes a square-sectioned tube as the principle member of the struts 17 and 18. Upper bracket 21 could be positioned with the tube by either rivets, pinning, welding or indeed by force or friction fit. This configuration would also necessitate, as shown in FIG. 5, a variation in the configuration of the bottom plates 19 and 20, which can be formed as an extension of the material or as a separate bolted on plate. Both arrangements can be considered equivalent structures, however, the square tube construction may have advantages as to imparting more rigidity to the overall structure.

Since various modifications can be made to the structure as hereinabove described without departing from the spirit and scope of the claims. For example, to facilitate any required adjustment in length of struts 17 and 18 to accommodate slight variations in door width, each of struts 17 & 18 could be composed of two separate sections, one telescoping within the other. Further, additional brackets could be utilized to hold struts 17 and 18 against the door 2, these brackets being located to be attached to the door panel as frame, it is intended therefore, that all matter contained in the accompanying specification, shall be interpreted as illustrative only and not in a limiting sense.

What I claim is:

1. A system for reinforcing multi-sectional doors of the type including multiple horizontal panels interconnected at each longitudinal side to adjacent panels, the system including corner plate means adapted for attachment to opposite lower corners of a bottom panel section of said door; first and second strut means one end of each said strut means fixedly attached to a respective one of said corner plate means, each said strut means extending upwardly and inwardly of said panel structure; an upper end of each said strut means being terminally attached to upper connector means such that said corner means, said strut means and said connector means define a substantially rigid triangular frame means within the confines of said bottom panel structure adjacent an inner facing surface thereof; pin means operably associated with said upper connector means to extend vertically downwardly therefrom to lower bracket means, adapted for attachment to a bottom said door; intermediate bracket means located vertically above said lower bracket means and spaced between said lower bracket means and said connector means, said intermediate bracket means adapted for attachment to said door and configured to positionally support and guide said pin means; means to put said pin means into tension and exert an upward force on the bottom of said door, while exerting a compressive force via said strut means to said corner plate means, thus compensating for door weight and eliminating sagging.

2. The system according to claim 1, wherein said pin means comprises a longitudinal metal rod of circular cross-section, the upper and lower extremities of which are threaded.

3. The system according to claim 2, wherein adjustment means cooperating with the lower threaded extremity of said pin means and said lower bracket means, affect attachment of the pin means to said bracket means and permit longitudinal adjustment of said pin means.

4. The system according to claim 1, wherein each of said upper connector means, and said lower and intermediate bracket means are apertured to permit free passage of said pin means therethrough.

* * * * *